US008429825B2

(12) United States Patent
Johanson

(10) Patent No.: US 8,429,825 B2
(45) Date of Patent: Apr. 30, 2013

(54) CUTTING APPARATUS

(75) Inventor: James E. Johanson, Old Chatham, NY (US)

(73) Assignee: Sonoco Development, Inc., Hartsville, SC (US)

( * ) Notice: Subject to any disclaimer, the term of this patent is extended or adjusted under 35 U.S.C. 154(b) by 266 days.

(21) Appl. No.: 13/042,556

(22) Filed: Mar. 8, 2011

(65) Prior Publication Data

US 2011/0219630 A1 Sep. 15, 2011

Related U.S. Application Data

(60) Provisional application No. 61/312,359, filed on Mar. 10, 2010.

(51) Int. Cl.
*B26B 29/06* (2006.01)
*B26B 3/08* (2006.01)

(52) U.S. Cl.
USPC ..... 30/2; 30/294

(58) Field of Classification Search ..... 30/2, 124, 30/286, 289, 294
See application file for complete search history.

(56) References Cited

U.S. PATENT DOCUMENTS

| | | | | |
|---|---|---|---|---|
| 1,129,310 | A * | 2/1915 | Platt | 30/2 |
| 1,265,760 | A | 5/1918 | Edwards | |
| 1,795,527 | A | 3/1931 | Tyreman | |
| 1,796,870 | A | 3/1931 | Huhn et al. | |
| 2,204,267 | A | 6/1940 | Wyres | |
| 2,247,290 | A | 6/1941 | Disbrow | |
| 2,646,799 | A * | 7/1953 | Jacoby, Jr. | 606/181 |
| 2,797,477 | A | 7/1957 | Erdman | |
| 2,896,318 | A * | 7/1959 | Brown | 30/2 |
| 2,998,649 | A | 9/1961 | Miller et al. | |
| 3,003,236 | A | 10/1961 | Castelli | |
| 3,052,977 | A | 9/1962 | Wise | |
| 3,500,540 | A | 3/1970 | Lundquist | |
| 3,659,343 | A * | 5/1972 | Straus | 30/124 |
| 3,898,733 | A * | 8/1975 | Cormier | 30/90.4 |
| 4,053,979 | A | 10/1977 | Tuthill et al. | |
| 4,369,787 | A * | 1/1983 | Lasner et al. | 606/138 |
| D276,786 | S | 12/1984 | Chen | |
| 4,527,331 | A | 7/1985 | Lasner et al. | |
| 4,574,477 | A * | 3/1986 | Lemkin et al. | 30/92 |
| 4,574,805 | A | 3/1986 | Lerner | |
| 4,711,031 | A | 12/1987 | Annello | |

(Continued)

FOREIGN PATENT DOCUMENTS

FR 2 596 682 A1 10/1987

OTHER PUBLICATIONS

EP Search Report corresponding to EP application No. 11157304.4.

*Primary Examiner* — Hwei C Payer
(74) *Attorney, Agent, or Firm* — Flaster/Greenberg, P.C.

(57) ABSTRACT

A cutting apparatus is provided having a resilient handle, a guide on one end of the handle and a cutter body on the opposite end. The guide includes two spaced members forming an outwardly facing slot with a stop formed therein. The handle is flexed into an assembled position to form a close loop, with the cutter body positioned within the guide slot and in contact with the stop. A cutting edge is movable along with cutter body to an activated position, with the cutting edge extending outwardly of the slot and the guide. The movement of the cutter body is caused by an activation force applied to the closed loop of the resilient handle member.

23 Claims, 6 Drawing Sheets

U.S. PATENT DOCUMENTS

| | | | | | |
|---|---|---|---|---|---|
| 4,807,622 | A | * | 2/1989 | Ohkaka et al. | 606/167 |
| 4,852,255 | A | | 8/1989 | Hochfeld | |
| 5,016,353 | A | | 5/1991 | Iten | |
| 5,047,037 | A | * | 9/1991 | Brandfield | 606/138 |
| 5,075,974 | A | | 12/1991 | McIlhatten | |
| 5,103,562 | A | * | 4/1992 | Braatz | 30/294 |
| 5,237,749 | A | * | 8/1993 | Henning et al. | 30/123.6 |
| 5,333,381 | A | | 8/1994 | Gelardi et al. | |
| 5,697,157 | A | | 12/1997 | Votolato | |
| 5,711,075 | A | | 1/1998 | Wolf | |
| 5,943,780 | A | | 8/1999 | McIlhatten | |
| 7,073,264 | B2 | | 7/2006 | Votolato | |
| 7,730,620 | B1 | * | 6/2010 | Anastasi | 30/294 |

* cited by examiner

CUTTING APPARATUS

RELATED APPLICATION

The present application claims the benefit of the filing date of U.S. provisional application No. 61/312,359, filed Mar. 10, 2010.

FIELD

The present invention relates to an apparatus for securing a cutting blade for use in cutting materials.

BACKGROUND

It is known to use a cutting blade to cut various materials, such as corrugated board, paper and paperboard. There are a number of known devices that support a cutting blade on a handle, with the blade being retractable in some fashion into the handle.

U.S. Pat. No. 3,500,540 to Lundquist shows a generally U-shaped handle having a cutting blade mounted on the end of one leg and a guide member formed on the opposite leg. The cutting blade is positioned within a slot formed on the top of the guide member, closing the U-shape opening of the handle. A squeezing force directs the cutting blade further into the guide to project from the bottom of the guide, through an outwardly directed slot. Removal of the squeezing force returns the cutting blade back to its normal position on top of the guide.

U.S. Pat. No. 3,052,977 to Wise shows a cutter having a base plate on which is pivoted a handle. A blade mount is provided on the end of the handle, opposite the pivot. The combination of the pivoting base and handle form a U-shaped cutter, with the cutting blade directed into a slot formed in the top of the base plate. A spring is provided on the pivot to create a resilient movement between the handle and base. Squeezing the handle about the pivot moves the cutting blade into and through the slot to project from the bottom surface of the base plate. Removal of the flexing force returns the handle to the normal position, in which the blade is covered within the slot.

U.S. Pat. No. 5,943,780 to McIlhatten shows a cutter having a base plate on which is supported a handle that supports a cutting blade. The base is made of a resilient material such that the handle can be moved between a normally retracted position, in which the cutting blade is retained within a housing. Forcing the handle against the resilience of the base causes the blade to project through a slot in the base. Removal of the flexing force returns the handle to its normal position, in which the blade is covered by the housing.

BRIEF SUMMARY OF THE INVENTION

A cutting apparatus is provided having a resilient U-shaped handle, a guide on the end of one leg and a cutting edge on the opposite leg. The guide includes an outwardly facing slot with a stop formed therein. The legs of the U-shaped handle are flexed into an assembled position to form a close loop with the cutting edge positioned within the guide slot and, preferably, in contact with the upper stop. The cutting edge may be formed as a cutting blade, attached to a cutter body. The cutting edge is movable, along the cutter body, to an activated position, with the cutting edge extending outwardly of the slot and the guide. The movement of the cutting edge is caused by an activation force applied to the closed loop of the resilient handle member.

The cutting apparatus may also include stop members formed to define a limit to the extension of the cutting edge from the guide during the flex of the handle towards the activated position.

The cutting apparatus may also include a fixing means for securing the cutting edge within the guide slot, with the fixing member being selectively movable to permit movement of the cutting edge outside of the guide and to deter accidental or unintentional activation of the cutter.

Preferably, the cutting apparatus is integrally molded, with the handle, guide and cutter body being molded in one shot. The cutting edge may be separately attached to a cutter body or may be formed during the molding of the cutter body.

BRIEF DESCRIPTION OF THE DRAWINGS

For the purpose of illustrating the invention, there is shown in the drawings various embodiments that are presently preferred. It should be understood, however, that the invention is not limited to the precise arrangements and instrumentalities shown.

DETAILED DESCRIPTION

Figure 1:
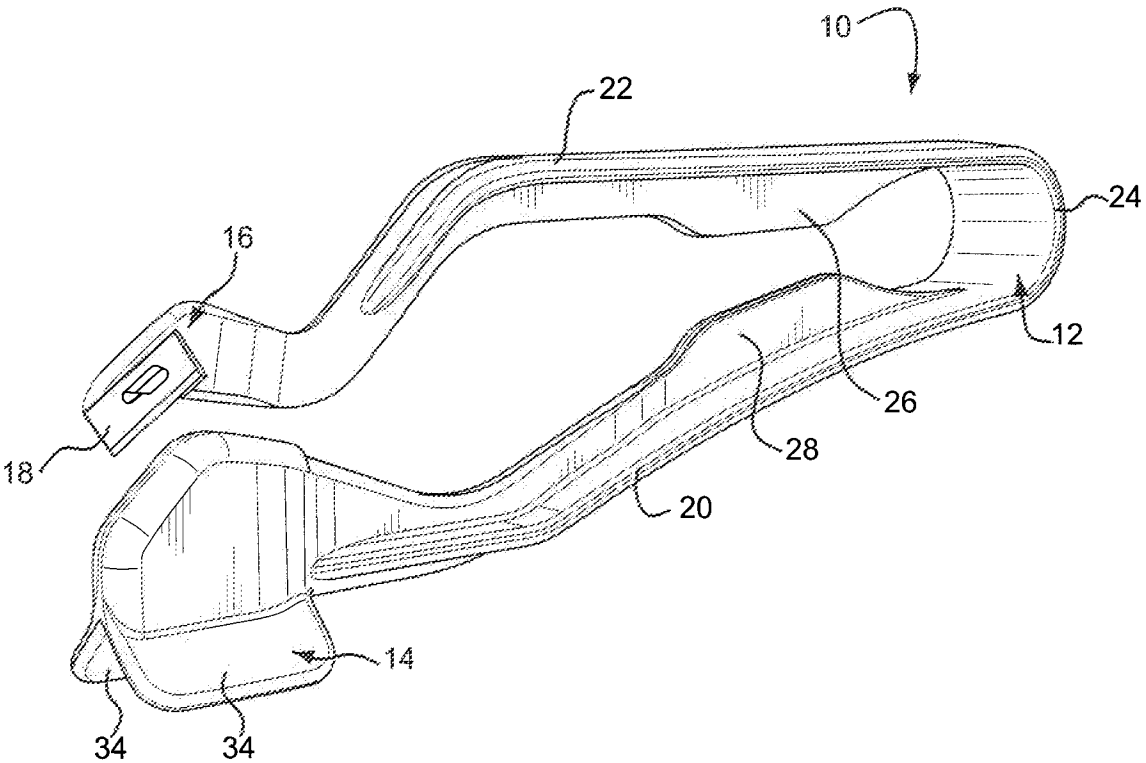
FIG. 1 is a perspective view of an embodiment of the cutting apparatus of the present invention.

In the drawings, where like numerals identify like elements, there is shown an embodiment of a cutting apparatus, which is generally designated by the numeral 10. The apparatus 10 as shown includes a curved handle member 12 having a cutter body 16 on one end and a guide member 14 on the opposite end. As shown, the cutter body portion 16 includes a cutting edge 18 in the form of a separately attached cutting blade. The cutting edge 18 operationally projecting from the cutter body 16. The handle 14 is formed as having a U-shaped construction with two leg portions 20, 22 and a central curve 24.

In the embodiment shown, the apparatus 10 is injection molded to form a unitary construction for the handle 12, guide 14 and cutter body 16. The molded configuration of the handle 12 is open at the projected ends of legs 20, 22 with the cutter body 16 generally aligned with, but spaced from, the guide 14. The handle 12, guide 14 and cutter body 16 are preferably molded from a resilient plastic material, such that the two legs 20, 22 of the handle can be flexed relative to one another about the central curve 24.

Figure 2:
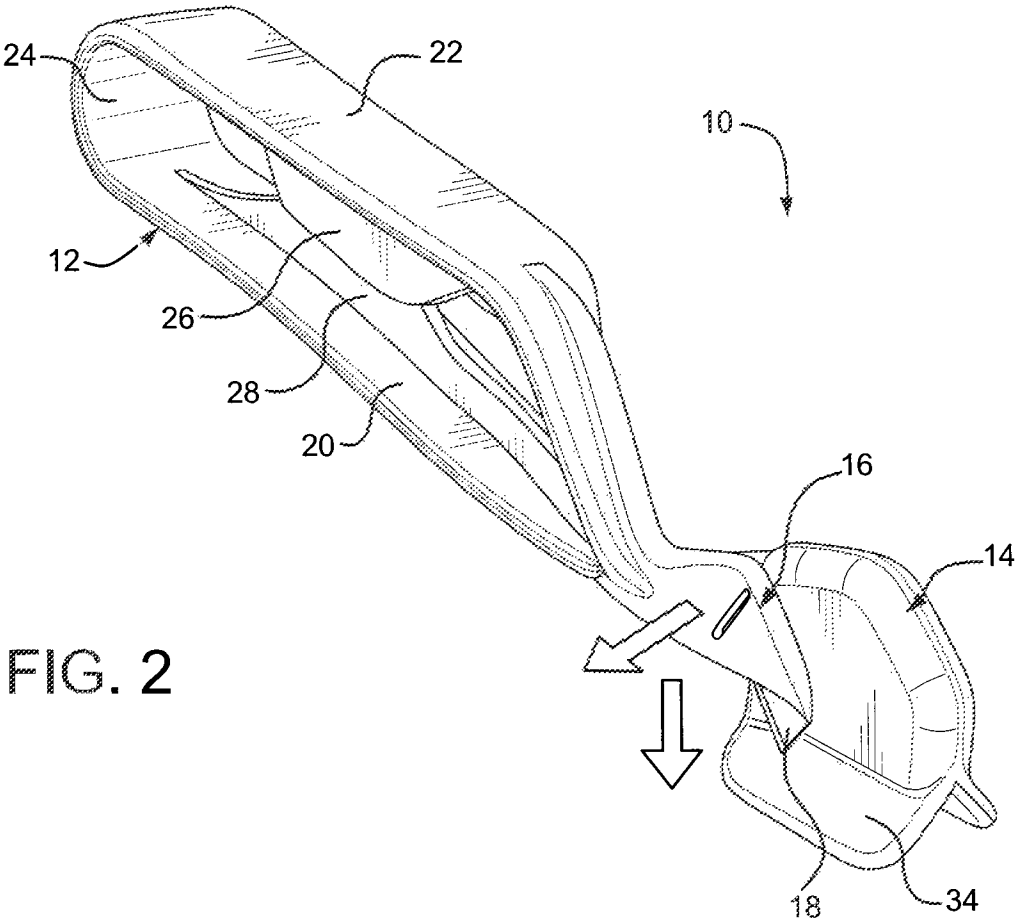
FIG. 2 is a perspective view of the embodiment of the cutting apparatus of FIG. 1 during its movement to an assembled position.

As shown in FIG. 2, the apparatus is assembled by moving the two legs 20, 22 toward one another (see down arrow) while offsetting the position of the guide 14 and the cutter body 16 (see lateral arrow). Stop members in the form of top and bottom bumpers 26, 28 are produced on the inside surfaces of the legs 22, 20 (respectively). In FIG. 1, the bumpers 26, 28 are contemplated to be aligned. In FIG. 2, the top bumper 26 formed on the top leg 22 is positioned in front of the bottom bumper 28 on the other leg 20, due to the offset (lateral arrow) of the handle 12.

Figure 3:
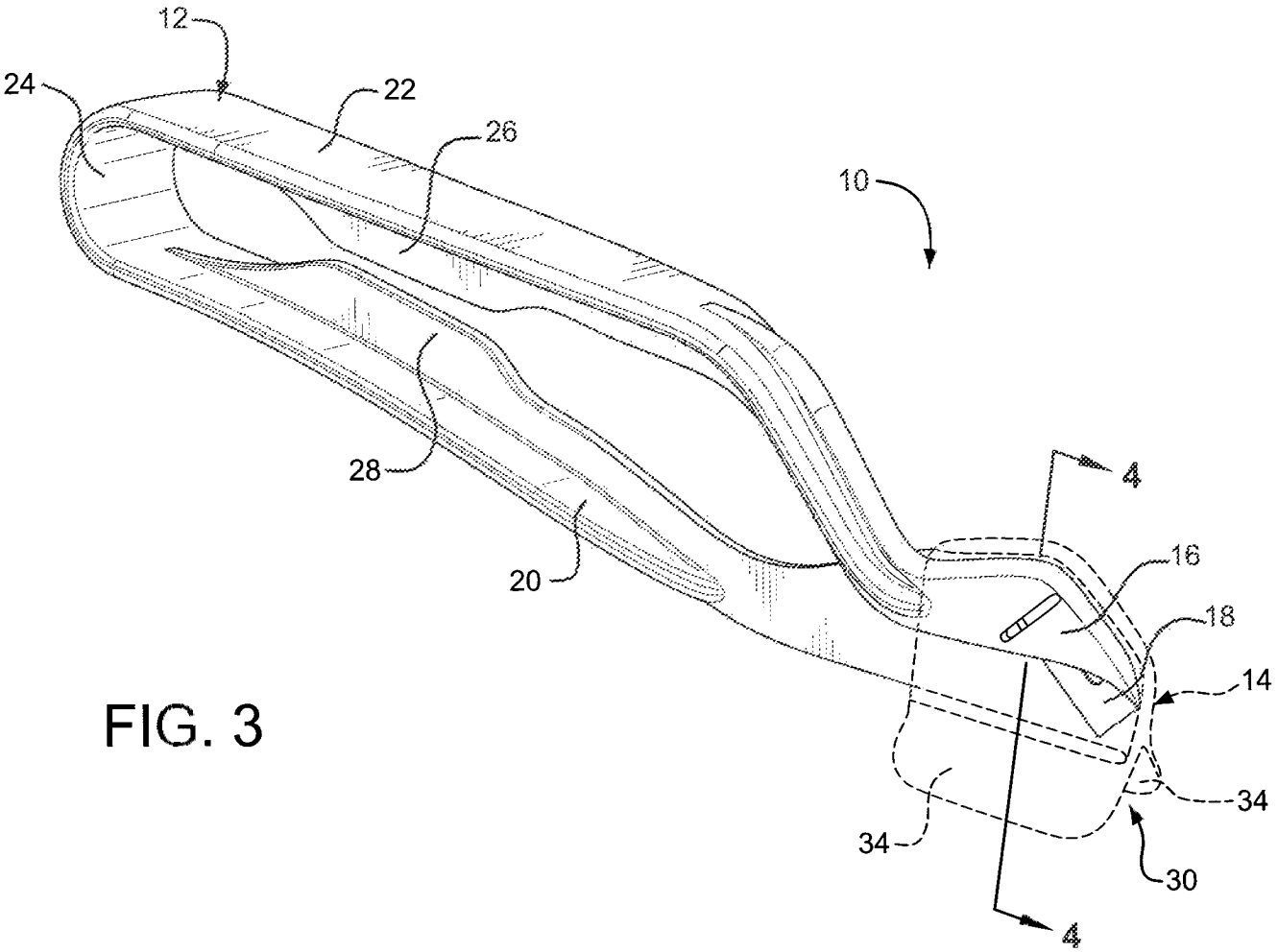
FIG. 3 is a perspective view of the embodiment of the cutting apparatus of FIGS. 1 and 2 in the assembled position.

The apparatus 10 is shown in FIG. 3 in an assembled or normal condition. For illustration purposes, the guide 14 is shown in phantom and the cutter body 16 and cutting edge 18 are positioned within the guide 14. During assembly, the cutter body 16 is moved from the offset position of FIG. 2 to a position under the guide 14 and then aligned with a slot 30 formed by the guide 14. After alignment and release of the assembly force, the cutter body 16 moves into the slot within the guide 14, as shown in the cross section of FIG. 4. In this assembled position, the open end of the U-shaped handle 12 is closed, with the guide 14 and cutter body 16 being merged and the handle 12 forming a closed loop, with the cutter/guide combination at one end of the legs 20, 22 and the central curve 24 formed at the opposite end.

Figure 6:
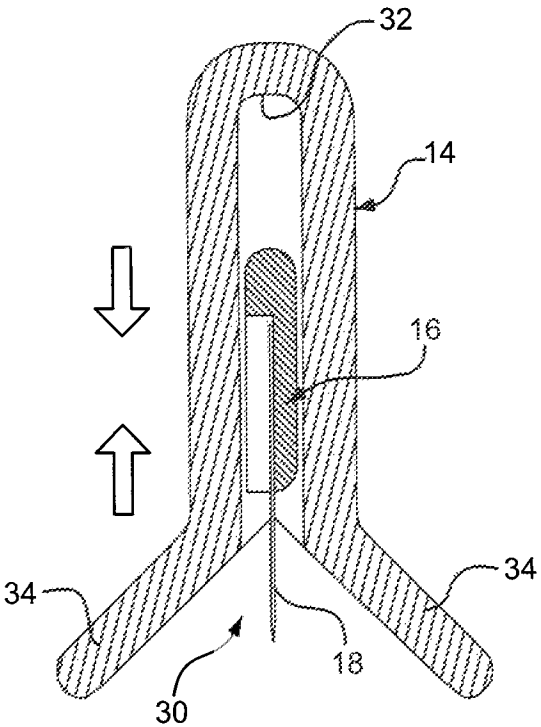
FIG. 6 is a cross sectional view of the cutting apparatus as taken along line 6-6 in FIG. 5.
Figure 4:
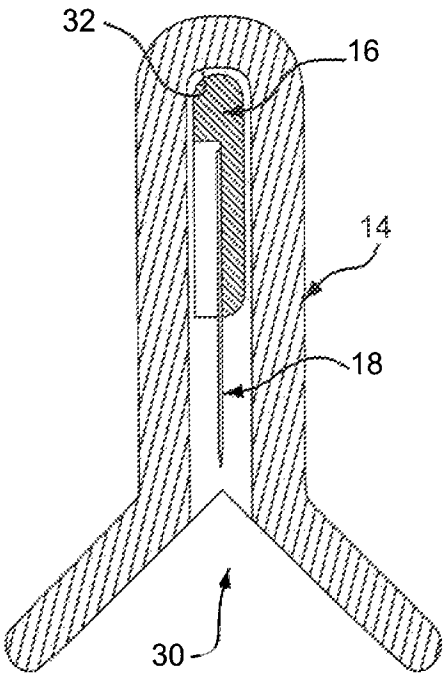
FIG. 4 is a cross sectional view of the cutting apparatus as taken along line 4-4 in FIG. 3.

The slot 30 is more particularly shown in the cross sections of FIGS. 4 and 6. The resilient nature of the materials used to form the handle 12 naturally moves the cutter body 16 into the slot 30. When the assembly force is released, the cutter body 16 moves into the slot 30 and contacts a stop 32 as shown in FIG. 4. The stop 32 as shown is the upper inside surface of the slot 30 in the guide 14. Other forms of stops may be provided to position the cutter body 16 on the guide 14. The dimensional relationship between the slot 30 of the guide 14 and the cutter body 16 positions the cutting edge 18 within the guide 14 without the cutting edge being exposed.

Figure 5:
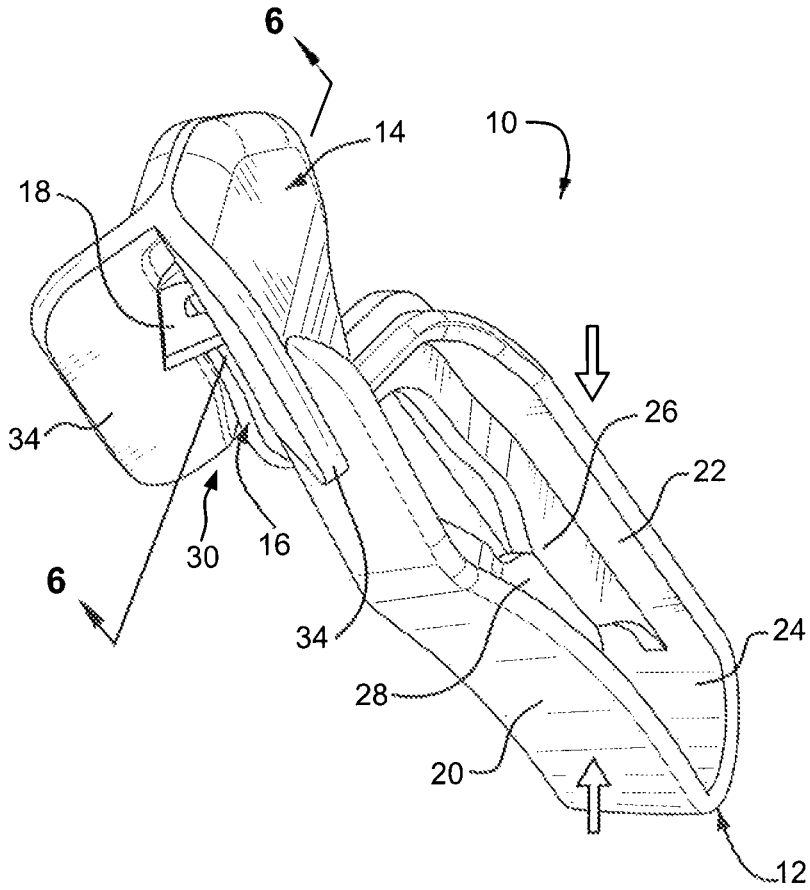
FIG. 5 a bottom perspective view of the embodiment of the cutting apparatus of FIGS. 1-4 wherein the cutter portion is moved to its operational position.

In FIG. 5, the apparatus 10 is shown in its activated or cutting position. The cutting edge 18 is projected out of the slot 30 by applying an activation force on the two legs 20, 22 of the handle 12. (The activation force is illustrated by the two converging arrows.) The force pushes the two legs together, creating a flex about the curve 24. As shown in FIG. 6, the activation force causes the cutter body 16 to move relative to the guide 14. The cutter body 16 moves away from the stop 32 within the slot such that the cutting edge 18 is projected out of the slot 30 and is ready to cut.

FIG. 5 shows the bumpers 26, 28 in contact with one another. The relative positioning of the bumpers 26, 28 on the handle legs 20, 22 serves as an activation stop, preventing the movement of the cutting edge 18 beyond a certain distance from the guide 14. Other forms of stop members may include nubs that project into the slot formed in the guide. The nubs would contact the cutter body during its activation movement within the slot and deter further movement. The nubs may also create a resistance to initial assembly by deterring the insertion of the cutter into the slot. A higher activation force would be required, along the lines of a press-fit relationship between parts that relaxes after overcoming the initial deterrence.

As shown, the guide 14 includes a pair of finger members 34, each positioned on opposite sides of the slot 30. The fingers 34 are set at an internal angle approaching 90 degrees (see FIGS. 4 and 6). The fingers 34 serve as a contact plane for the adjacent outside surfaces of the corner of a box, or the like. Thus, the fingers are passed along a corner of a formed box, while the cutting edge 18 is activated into the cutting position. Other forms of contact guides may be provided, including fingers at dihedral angles (e.g., for cutting a box along an inside corner), planer fingers forming a flat surface with the slot formed therein, etc. Alternatively, the fingers may be one or more projected edges of the guide.

Preferably, the cutting apparatus is formed in a one-piece injection molding operation, with the handle, guide and cutter body being integrally formed. The cutting edge may be molded as part of the cutter body, or a blade may be insert molded, attached in a secondary (post molding) operation or otherwise secured to the cutter body. The attachment of a cutting blade may be accomplished by any known means, such as snap fit onto a formed number on the cutter body, adhesive, etc. If integrally molded, the cutting edge may need to be sharpened, as a separate step from the molding operation.

In the form shown, the assembly step leaves the handle with a small pre-load force, pushing the cutter body into the guide slot and against the stop. A relatively small activation force is contemplated to move the cutting edge from its normal (post assembly) position shown in FIG. 4 to the activated or cutting position shown in FIG. 6, with the cutting edge exposed.

Figure 7:
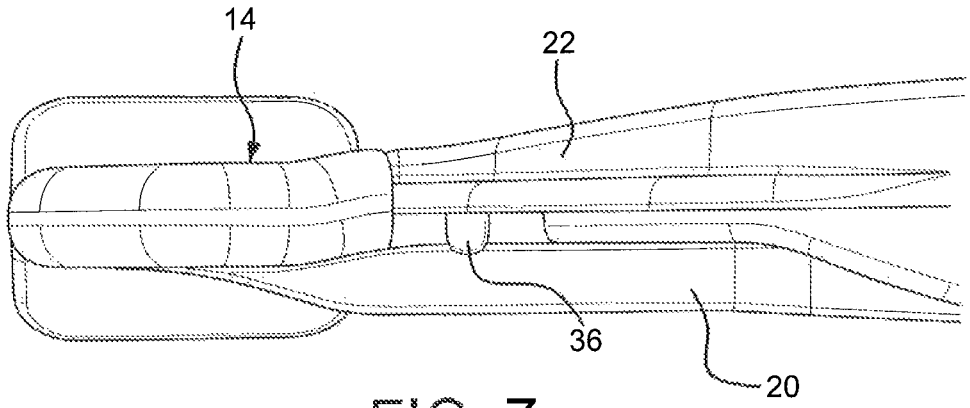
FIG. 7 is a partial top perspective view of an embodiment of the cutting apparatus of the present invention.
Figure 8:
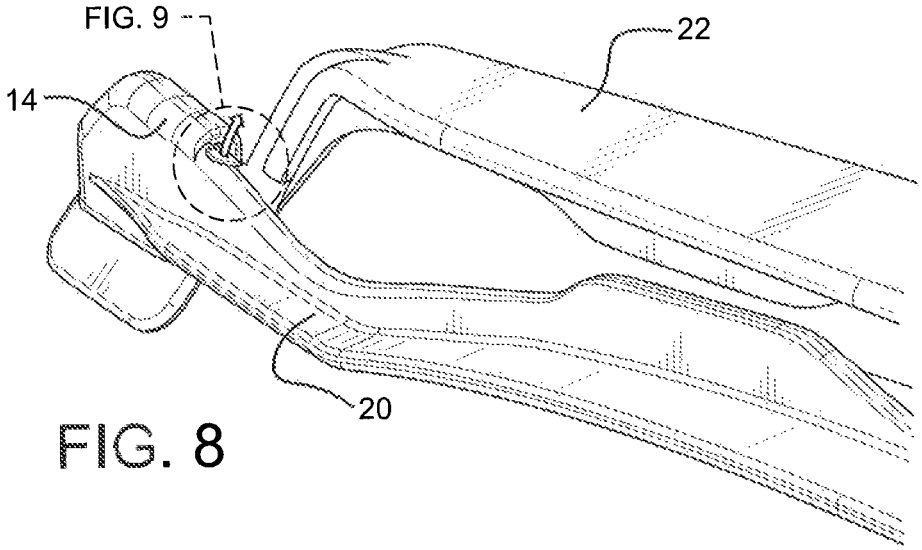
FIG. 8 is a partial perspective view of the cutting apparatus embodiment of FIG. 7.
Figure 9:
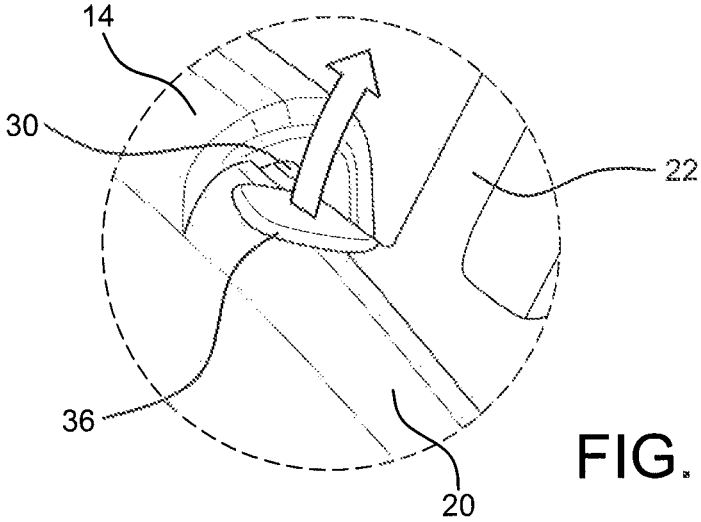
FIG. 9 is an enlarged view of a portion of the cutting apparatus embodiment of FIGS. 7 and 8.

A fixing member may also be provided to secure the cutter body within the slot of the guide to prevent accidental activation. One form of fixing member is shown in FIGS. 7-9 as a flexible tab 36 extending from the upper leg 22. As shown, the tab 36 extends at an angle from the plane of the leg 22 adjacent its entrance into the guide 14, upon placement of the cutter 16 in the guide slot 30 (as in FIGS. 2 and 3). The tab 36 extends across the upper surface of the bottom leg 20. The interference of the tab 36 and the bottom leg blocks movement of the upper leg 22 downwardly, thus securing the cutter body 16 and cutting edge 18 and fixing them from moving out of the guide slot 30 (as in FIGS. 4 and 6). The tab is contemplated to be relatively flexible, such that a releasing force (as shown by the arrow in FIG. 9) will selectively permit movement of the tab 36 out of its interfering position and permit the upper leg 22 to slide relative to the bottom leg 20 during application of the activation force (see arrows in FIG. 5).

The flexibility of the tab 36 is contemplated to be controlled, wherein the interference with the bottom leg 20 will be sufficient to make unintentional activation unlikely during handling, such as, for example, when the cutting apparatus is placed in a pocket for temporary storage. Further, the tab 36 is preferably integrally formed with the remaining portions of the handle 12. The material of the tab 36, along with its construction and positioning on the handle 12, is contemplated to create a relatively resilient structure that will accept repeated applications of a releasing force without significant deformation or break-off. The tab 36 will, preferably, resiliently return to its engagement position upon removal of the releasing force and not interfere with the return of the cutting blade 18 back into the guide slot 30. The fixing means may take on other forms and positions on the handle for deterring unintentional activation of the cutting blade.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A cutting apparatus comprising:

a guide;

a cutter body having a cutting edge thereon; and a handle member, the handle member being integrally formed with the guide and the cutter body, the guide positioned at one end of the handle member and the cutter body positioned at the opposite end, the guide having two spaced members forming a receiving slot with an outwardly facing opening, the handle member resiliently flexed to position the cutter body within the receiving slot and to form a closed loop, the resilient flex of the handle member normally directing the cutter body into and retaining the cutting edge within the slot, the cutting edge facing outwardly toward the outwardly facing opening of the guide when resiliently retained by the initial flex of the handle member in the normal position within the guide, and the cutter body having a second position wherein the cutting edge is moved through the opening, outside of the slot and adjacent the guide, the cutter body being movable to the second position by the application of an activation force to the handle member, the activation force moving the cutter body between the normal position and the second position by flexing of the handle member and resiliently returning to the normal position after removal of the activation force.

2. The cutting apparatus of claim 1 further comprising stop members formed on the guide, the stop members defining a limit to the extension of the cutting edge from the guide during the further flex of the handle member towards the second position.

3. The cutting apparatus of claim 1 further comprising stop members formed on the handle member, the stops members defining a limit to the extension of the cutting edge from the guide during the further flex of the handle member towards the second position.

4. The cutting apparatus of claim 1 wherein at least the guide and the handle member are integrally molded.

5. The cutting apparatus of claim 4 wherein a portion of the cutting edge is integrally formed with the guide and the handle member.

6. The cutting apparatus of claim 1, wherein the cutting edge is separately formed from the guide and the handle member.

7. The cutting apparatus of claim 1 further comprising a fixing member for securing the position of the cutting edge with the guide and deterring unintentional movement of the cutter body and the extension of the cutting edge from the guide.

8. The cutting apparatus of claim 7 wherein the fixing member is formed as a resilient tab on the handle member for creating interference on the flexing of the handle member and to deter movement of the cutter body from the normal position, with the cutting edge positioned in the guide, and the second position, the interference being removed upon application of a releasing force to the tab.

9. A cutting apparatus comprising:

a guide;

a cutter body; and a resilient handle member connected to the cutter body and the guide;

the guide having two spaced plane members forming a slot, an upper stop formed at one end of the slot and an outwardly facing aperture through a bottom portion of the guide, the guide attached to one end of the handle member, the handle member extending from the guide to a position above the guide and being directed back toward the guide to form an open loop, the cutter body attached to the other end of the handle member, the resilience of the handle member permitting the flexing of the handle member to an assembled position to close the loop and position the cutter body within the slot in contact with the upper stop;

the cutter body having a cutting edge, the cutting edge located within the slot in the assembled position and movable along with the cutter body to an activated position, the cutting edge extending outwardly of the slot when an activation force is applied to the closed loop of the resilient handle member.

10. The cutting apparatus of claim 9 wherein the plane members further comprise a corresponding pair of angled members positioned on opposition sides of the slot, the angled members diverging outwardly from the slot.

11. The cutting apparatus of claim 10 further comprising at least one stop for limiting extension of the cutter body and exposure of the cutting edge from the guide.

12. The cutting apparatus of claim 9 comprising a further stop to fix the position of the cutting edge with respect to the guide.

13. The cutting apparatus of claim 9 further comprising fixing means to deter accidental activation of the cutter body and movement of the cutting edge from the slot.

14. The cutting apparatus of claim 9 further comprising a flexible tab formed on the handle member for creating interference on the flexing of the handle member and to deter movement of the cutter body from the normal position, with the cutting edge positioned in the guide, and the second position, the interference being removed upon application of a releasing force to the tab.

15. A cutting apparatus comprising:

a guide;

a cutter body having a cutting edge thereon; and a handle member, the handle member being integrally formed with the guide and the cutter body, the guide positioned at one end of the handle member and the cutter body positioned at the opposite end, the guide having a receiving slot with an outwardly facing opening, the handle member being resiliently flexible to position the cutter body within the receiving slot and to form a closed loop within a normal assembled position, the resilient flexibility of the handle member directing the cutter body into and retaining the cutting edge within the slot and facing the outwardly facing opening of the guide, and the cutter body having a second position wherein the cutting edge is moved through the opening, outside of the slot and adjacent the guide.

16. The cutting apparatus according to claim 15 further comprising at least one stop member formed on the guide, the stop member defining a limit to the extension of the cutting edge from the guide in the second position.

17. The cutting apparatus according to claim 15 further comprising one or more stop members formed on the handle member, the one or more stop members defining a limit to the extension of the cutting edge from the guide in the second position.

18. The cutting apparatus according to claim 15 wherein the cutting edge is separately formed from the cutter body.

19. The cutting apparatus according to claim 15 further comprising a fixing member for selectively securing the position of the cutting edge within the guide and deterring unintentional movement of the cutter body out of the normal assembled position.

20. The cutting apparatus according to claim 19 wherein the fixing member is formed as a flexible tab formed on the handle member, the tab creating in a first condition interference on the flexibility of the handle member and deterring movement of the cutter body from the normal position, and in a second condition releasing the handle member for movement of the cutter body for movement to the second position.

21. The cutting apparatus according to claim 15 wherein the guide further comprises two spaced plane members forming the receiving slot, and an upper stop formed at one end opposite the outwardly facing opening.

22. The cutting apparatus according to claim 21 wherein the plane members further comprise a corresponding pair of angled members positioned on opposite sides of the slot, the angled members diverging outwardly from the slot.

23. The cutting apparatus according to claim 15 wherein the cutter body is resiliently retained against the guide by the resilient flexibility of the handle member in the normal assembled position, and an activation force being required to move the cutter body between the normal retained position and the second position.

* * * * *